US008534298B2

(12) United States Patent
Honnefeller et al.

(10) Patent No.: US 8,534,298 B2
(45) Date of Patent: Sep. 17, 2013

(54) HAIR CARE DEVICE

(75) Inventors: Katja Honnefeller, Friedrichsdorf (DE); Michael Kloeppel-Riech, Friedberg (DE); Norbert Smetana, Frankfurt am Main (DE); Olaf Soerensen, Mainz (DE); Juergen Seng, Kelkheim (DE)

(73) Assignee: Braun GmbH, Kronberg (DE)

( * ) Notice: Subject to any disclaimer, the term of this patent is extended or adjusted under 35 U.S.C. 154(b) by 55 days.

(21) Appl. No.: 12/674,051

(22) PCT Filed: Jul. 22, 2008

(86) PCT No.: PCT/EP2008/005979
§ 371 (c)(1),
(2), (4) Date: Jun. 2, 2010

(87) PCT Pub. No.: WO2006/015803
PCT Pub. Date: Feb. 5, 2009

(65) Prior Publication Data

US 2011/0094535 A1 Apr. 28, 2011

(30) Foreign Application Priority Data

Jul. 27, 2007 (DE) ..... 10 2007 035 247

(51) Int. Cl.
*A46B 15/00* (2006.01)

(52) U.S. Cl.
USPC ..... 132/148; 132/271

(58) Field of Classification Search
USPC ..... 132/118, 120, 126, 148, 219, 221, 132/271, 272; 15/160, 169, 184, 185, 246
IPC ..... A45D 20/10,1/04; A45B 15/00
See application file for complete search history.

(56) References Cited

U.S. PATENT DOCUMENTS 4,797,966 A * 1/1989 Fong ..... 15/186
5,150,491 A * 9/1992 Ikemoto ..... 15/1.52

(Continued)

FOREIGN PATENT DOCUMENTS

JP 2003/189925 A 7/2003
JP 2004/344354 A 12/2004
JP 2006/198045 A 8/2006

OTHER PUBLICATIONS

All Office Actions, U.S. Appl. No. 12/674,053.

(Continued)

*Primary Examiner* — Robyn Doan
*Assistant Examiner* — Tatiana Nobrega
(74) *Attorney, Agent, or Firm* — Jeffrey V Bamber; Kim W Zerby

(57) ABSTRACT

The present invention relates to a hair care device (1), having a handle (3), a function head (4) which can be connected to the handle (3), and which has a hair treatment device (5), particularly a brush and/or a tooth field, and having an ion-discharging device (9) for discharging ions onto the hair, the ion-discharging device (9) having at least one ion outlet (11). According to the invention, the hair care device (1) is characterized in that the function head (4) and/or a housing part which surrounds the ion outlet (11) has at least one grounding area for dissipating/limiting electronic charges. Advantageously, the ions are discharged exclusively from the back of the device (8) which faces away from the hair treatment device (5), while the grounding area on the function head (4) can be provided on the front of the device.

16 Claims, 8 Drawing Sheets

(56) References Cited

U.S. PATENT DOCUMENTS

| | | | | |
|---|---|---|---|---|
| 5,975,090 | A * | 11/1999 | Taylor et al. | 132/116 |
| 6,029,307 | A * | 2/2000 | Baudoin | 15/145 |
| 6,042,637 | A * | 3/2000 | Weinberg | 96/58 |
| 6,907,888 | B2 | 6/2005 | Saida et al. | |
| 7,287,532 | B2 * | 10/2007 | Hafemann | 132/232 |
| 7,584,759 | B2 | 9/2009 | Yasuda et al. | |
| 7,886,698 | B2 * | 2/2011 | Leonard | 119/601 |
| 2002/0062836 | A1 * | 5/2002 | Saida et al. | 132/271 |
| 2002/0100488 | A1 * | 8/2002 | Taylor et al. | 132/271 |
| 2004/0129288 | A1 * | 7/2004 | Saida et al. | 132/228 |
| 2004/0172847 | A1 * | 9/2004 | Saida et al. | 34/96 |
| 2005/0016559 | A1 * | 1/2005 | Saida et al. | 132/271 |
| 2005/0284495 | A1 * | 12/2005 | Yasuda et al. | 132/272 |
| 2007/0174984 | A1 * | 8/2007 | Diamond | 15/106 |
| 2008/0040878 | A1 * | 2/2008 | Choi et al. | 15/184 |
| 2010/0064979 | A1 * | 3/2010 | Leonard | 119/601 |
| 2010/0269841 | A1 * | 10/2010 | Honnefeller et al. | 132/120 |
| 2010/0269849 | A1 * | 10/2010 | Ishikawa et al. | 132/271 |
| 2010/0282268 | A1 * | 11/2010 | Honnefeller et al. | 132/120 |
| 2011/0005539 | A1 | 1/2011 | Honnefeller et al. | |
| 2011/0088275 | A1 | 4/2011 | Kloeppel-Riech et al. | |
| 2011/0088714 | A1 | 4/2011 | Kloeppel-Riech et al. | |
| 2011/0094528 | A1 * | 4/2011 | Leung | 132/120 |
| 2011/0239390 | A1 * | 10/2011 | Park | 15/160 |
| 2011/0315158 | A1 | 12/2011 | Kloeppel-Riech et al. | |

OTHER PUBLICATIONS

All Office Actions, U.S. Appl. No. 12/669,915.
All Office Actions, U.S. Appl. No. 12/674,732.
All Office Actions, U.S. Appl. No. 12/673,981.
U.S. Appl. No. 12/674,053, filed Mar. 2, 2010, Kloeppel-Riech et al.
U.S. Appl. No. 12/674,732, filed May 27, 2010, Kloeppel-Riech et al.
U.S. Appl. No. 12/673,981, filed Feb. 18, 2010, Kloeppel-Riech et al.
U.S. Appl. No. 12/669,915, filed Aug. 10, 2012, Honnefeller et al.

* cited by examiner

HAIR CARE DEVICE

The present invention relates to a hair care device having a handle, a function head that can be connected to the handle and which has a hair treatment device, particularly a brush and/or tooth field, and having an ion-discharging device for discharging ions onto the hair having at least one ion outlet.

Recently, hair care devices, particularly hairbrushes, have become known that in addition to their primary function—in the case of a hairbrush, the combing, brushing, and shaping of the hair—the discharge of ions is an additional application. Such ions are usually molecules charged with negative electrons. With the aid of such an ion application, the hair and hair care can be improved; in particular, a static charging of the hair and corresponding standing up of the hair can be avoided, and an improved moisturizing can also be achieved.

From US 2005/284495, a hair dryer is known having an integrated brush attachment that has an ion outlet on the back side of the device, facing away from the brush field, as well as on the front side of the device, which has the brush field, said outlet allows ions to exit in the direction of the function head.

In such hair care devices having ion applications, on the one hand the ions should of course be discharged onto the hair in a targeted fashion, while on the other hand the charging of the hair should not be concentrated at points, but should be as uniformly distributed as possible. Here, the ion discharge is impeded not only by direct mechanical obstacles such as hair situated in front of the ion outlet, or the hand of the user that gets in the way, but also by electrostatic counter-fields that can emanate from highly negatively charged components, which so to speak repel the negatively charged ions, or components having high positive charges, which have an attractive field effect on the ions. Such charges can for example arise at the brush field itself if this is used to comb through the hair. In the area of the ion discharge, electrostatic fields can also form on the device housing, which can impede the exiting of the ions.

A further aspect that is to be improved in known hair care devices of the type named above is user safety, which can be impaired by the above-named strong charges on the device.

On this basis, the present invention is based on the object of creating an improved hair care device of the type named above that avoids the disadvantages of the prior art and further develops the prior art in an advantageous manner. In particular, a uniform, efficient discharge of ions onto the hair is to be achieved without impairing the user safety of the device using simple means.

According to the present invention, this object is achieved by a hair care device according to Claim 1. Preferred embodiments of the present invention are the subject matter of the dependent claims.

Thus, it is proposed to use suitable countermeasures to remove an electrostatic charge and counter-fields at least on the parts of the hair care device that are in the way of the discharge of ions onto the hair or that can impair the ion discharge. Without impairment by such electrostatic counter-fields, a uniformly distributed but nonetheless targeted and efficient ion charging of the hair can be achieved even using a simple design of the ion discharge device, which, in a simple embodiment of the present invention, can make do with only a single ion outlet. According to the present invention, the hair care device is characterized in that the function head and/or a housing part that surrounds the ion outlet has at least one grounding surface for the conducting away/limitation of electrostatic charges. Such a grounding surface on the function head and/or on the housing part surrounding the ion outlet prevents or limits excess charging, and correspondingly prevents or limits electrostatic fields in the area of the function head and in the area of the ion outlet that could impede the discharge of ions onto the hair. In particular, such grounding surfaces may be present both on the function head and also on the housing part surrounding the ion outlet.

The grounding surface can in principle be designed in various ways. In particular, the grounding surface can be designed in the form of a metallic surface that is attached to a non-conductive body or housing part, preferably made of plastic, of the function head and/or of the ion outlet. The body of the function part or of the ion outlet itself can in addition be designed as a plastic injection-molded part or as a plastic part manufactured in some other way. The grounding surface in the form of a metallic surface, which is advantageously arranged on an external side of the named body parts and can form the outer surface thereof, not only prevents the fields that impair the ion discharge, but also increases the operational safety of the hair care device.

With regard to the arrangement of the grounding surfaces, various embodiments may be advantageous. On the function head, an advantageous arrangement may consist in that the grounding surface is connected to the hair treatment device, in particular to the brush and/or tooth field. For example, the grounding surface may form, so to speak, the bed that the brush or teeth of the brush field, or that bears the treatment tool, which may optionally also be designed differently, of the hair treatment device. Alternatively or in addition to the above-named brush and/or tooth field, the hair treatment device may for example also have a care surface made of a material suitable for hair care, such as ceramic. Alternatively or in addition, a heating surface may be provided having a suitable shape, in particular a smooth, concave, and/or convexly curved treatment surface. Alternatively or in addition, the hair processing device may also have a clamp or pincers for grasping individual strands of hair. In a possible and preferred embodiment, the function head, in particular the brush field, does not have air outlets, in particular air outlets that direct air entirely or partly onto the ion outlet, so that the airflow does not contribute, or does not contribute significantly, to the transport of ions to the hair.

Alternatively or in addition to the above-named embodiment in which the grounding surface is connected directly to the hair treatment device, the grounding surface on the function head can also surround at least segments of the periphery of the hair treatment device, preferably annularly, and/or can be arranged directly adjacent to the hair treatment device. In particular, a metallic strip can be provided around the hair treatment device on the function head as a grounding surface. Here, the hair treatment device itself, i.e. for example the brush and/or tooth field, or the housing body of the function head, can itself be made of non-conductive material. Advantageously, the grounding surface on the function head is not provided in the immediate vicinity of the at least one ion outlet. The grounding surface can advantageously be arranged on the edge next to the hair treatment device in the function head bearing the hair treatment device.

Also with regard to the arrangement of the grounding surface on the ion outlet, various embodiments may be advantageous. According to an advantageous development of the present invention, the ion outlet comprises a housing module that surrounds, in the shape of a box, a high-voltage element that emits the ions, said module having a port side in which an outlet opening is provided for the exiting of the ions produced by the high-voltage element. Advantageously, the above-named grounding surface is provided on one of the non-port sides of the named housing module. The port side of the housing module can in particular be designed so as to be completely free of counter-electrodes. Here, the grounding surface can be arranged on a side surface, adjacent to the port side, of the outlet housing, said side surface peripherally surrounding the above-named high-voltage element, which is preferably spike-shaped, pin-shaped, or tip-shaped. Alternatively or in addition, a grounding surface can also be provided on a rear outlet housing surface that is situated opposite the port side.

In a development of the present invention, the housing potential is also electrically contacted with the body of the user. In a development of the present invention, the handle of the hair care device can have an electrically conductive contact surface 23 for conducting positive or negative charges to the user of the hair care device. In this way, the user is protected from becoming charged. This is because the emission of negative ions can negatively charge the user. On the other hand, positive charges can be transferred to the user through the contact surface on the handle, compensating the charging effect by means of the negative ions. This is advantageous in particular in a design of the hair care device that does not have a mains connection, in particular a battery- and/or rechargeable device. In such a non-mains device, the generation of the negative ions usually causes an equivalent amount of positive charge on the device, because the device, as a battery or rechargeable device, lacks reference potential. A negative charging of the user can be compensated through conducting away the negative charge from the user to the contact surface (and thus to the handle). As a result, the user is neutrally charged relative to the device.

Due to the largely unimpaired ion discharge onto the hair achieved by the grounding surfaces and the charge fields on the device removed or restricted thereby, a particularly simple configuration of the ion discharge device can be achieved, in particular with regard to the arrangement of the ion outlet. In a development of the present invention, it can be provided in particular that the ion discharge takes place exclusively on the back of the device, which faces away from the hair treatment device that performs the primary function of the hair care device. Surprisingly, in this way an ion discharge can be achieved that is uniformly distributed but is nonetheless directed onto the hair in a targeted manner. Until now, it was typically sought to discharge at least a portion of the ions on the front of the device in the area of the hair treatment tool, in order so to speak to bring the ions directly into the area to be treated, because it was assumed that ions discharged at the back of the device would more or less miss the target, i.e. the hair to be cared for. In particular in connection with the above-described grounding surfaces and the removal or restriction of disturbing charge fields, a particularly uniformly distributed yet nearly complete discharging of the ions onto the hair can be achieved through an ion discharge at the back of the device, because the hair typically has a positive charge that is to be compensated by the discharged ions and that attracts the ions. This effect is sufficient if no stronger disturbing fields are present on the hair care device that would impede the ion discharge. Through the arrangement of the ion outlet, or of all the ion outlets on the back of the device, the ion discharge takes place without mechanical hindrance by a hand of the user or by strands of hair situated in front of the ion outlet.

In principle, a single ion outlet can be sufficient. Optionally, it is also possible to arrange a plurality of ion outlets on the back of the device. In both cases, the arrangement is preferably made symmetrical to the longitudinal center plane of the hair care device. Preferably, the at least one ion outlet, or the plurality of ion outlets, are created in such a way that a main exit direction of the ions, or the sum of the main exit directions of the ions, is oriented in the plane of the back surface, or over the surface of the back symmetrical to the longitudinal center plane. Here, the main exit direction of the ion outlet is advantageously oriented essentially parallel to the back surface, so that the ions exit essentially parallel to the back of the device, moving past this side. Alternatively or in addition, an ion emission that is spread with a slightly acute angle can be provided. Here, the ion discharge can be inclined to the surface of the back side at an angle of preferably 0° to 45°, preferably 0° to 30°.

In order to achieve a uniform ion distribution on the hair, the at least one ion outlet is arranged on the edge of the device back surface, situated opposite the hair treatment device, so that an ion cloud forms over the back of the function head.

If only a single ion outlet is present, this outlet is advantageously arranged in the longitudinal center plane itself. In the case of two ion outlets on the back of the device, these can be arranged at a distance from the longitudinal center plane, at the same level relative to one another, and preferably both can be inclined slightly away from the longitudinal center plane. Alternatively, given two ion outlets on the rear side of the device, an arrangement can be provided in which they are situated opposite one another such that the two ion outlets are arranged on opposed edges of the rearward function head surface and are directed toward one another so that the ions exit toward one another, so to speak.

These and further features of the present invention are based on the claims and on the following description and/or the accompanying drawings, wherein the features can form the subject matter of the present invention in various combinations and subcombinations with one another, as well as individually, without regard to their summarization in the claims. In the following, the present invention is explained in more detail on the basis of preferred exemplary embodiments and accompanying drawings.

Figure 1:
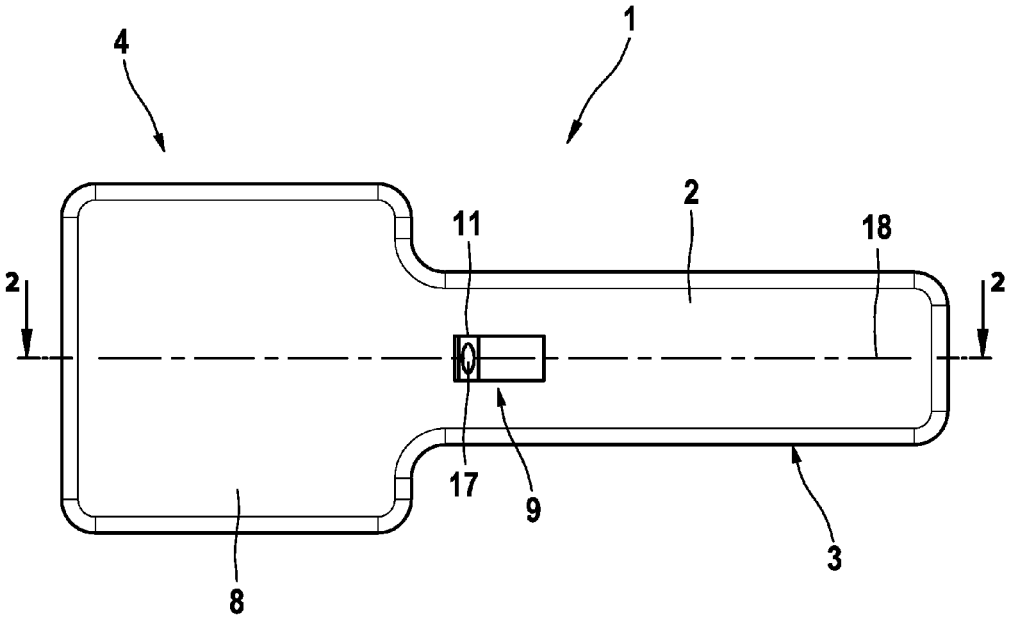
FIG. 1 shows a top view of the back of a hair care device in the form of a hair brush according to an advantageous embodiment of the present invention that shows the ion outlet in the longitudinal center plane on the edge of the back of the function head.

The hair care device 1 shown in FIGS. 1 and 2 comprises a device basic body 2 that has a handle 3 and that has electronic devices, described below, in its interior or on its outer shell. The named handle 3 bears a function head 4 that holds a brush field 6 as hair treatment device 5 on the front of the device 7. However, it is to be understood that other hair treatments tools, such as for example heating rods or hair shaping elements, or optionally also a blower outlet, can also be provided if the hair care device is designed as a hair shaping device and/or hair dryer. The named hair treatment tools can optionally also be combined with one another.

The named hair treatment device can be fixedly integrated into the function head 4. Alternatively, the hair treatment device 5 can advantageously be exchangeably mounted on the function head 4, so that a function head 4 can be equipped and used with various hair treatment devices 5.

Advantageously, the hair care device 1 can have a modular design having a plurality of components that can be placed on one another, wherein in particular the entire function head 4, and/or, in the named manner, the hair treatment device 5, can be designed separate from the device basic body 2. Here, positively fitting connecting means can advantageously be provided between the various components, for example in the form of snap pins and recesses, enabling the components to be removed and put back in place without the use of tools.

Figure 2:
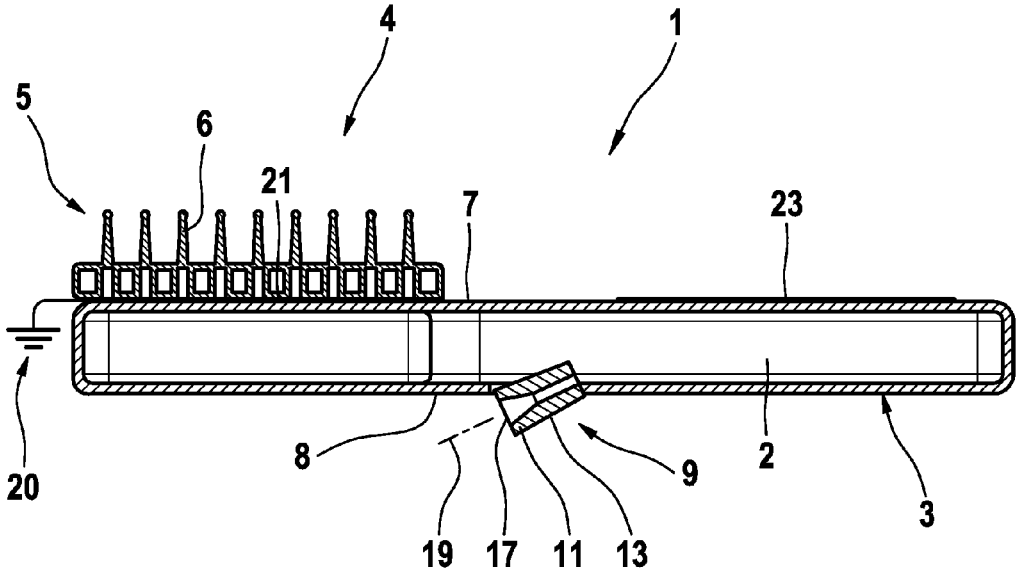
FIG. 2 shows a longitudinal section through the hair brush of FIG. 1 along the line A-A in FIG. 1, wherein a grounding surface on the function head is provided under the tooth field provided there.

As FIGS. 1 and 2 show, an ion discharge device 9 is additionally provided on the device basic body 2, on its back side of the device 8 facing away from hair treatment device 5, said discharge device has an ion emitter that is arranged in the interior space of the device basic body 2 and/or that can have a high-voltage element 12, arranged in the ion outlet 11, for the discharging of the ions. The named high-voltage element 12 can be arranged in a box-type or jacket-type outlet housing 13 whose wall has an exit opening 17 on a port side 14 through which the discharged ions can exit.

In the depicted embodiment, the ion outlet 11 is designed in the form of a nozzle or diffuser, and causes a directed exiting of ions; cf. FIG. 2. Advantageously, the ion outlet 11 is arranged on the back of the device 8, which is situated opposite the brush field 6, or faces away therefrom and forms so to speak the back of the hair brush. Advantageously, here the ion outlet 11 is arranged in the longitudinal center plane 18, which forms the plane of the drawing in FIG. 2, wherein advantageously the main exit direction 19 of the ion outlet 11 is inclined at a slightly acute angle to the surface of the back of the device and is oriented away therefrom; cf. FIG. 2, wherein the angle of inclination is advantageously between 0° and 45°, and in the depicted embodiment can advantageously be between approximately 20° and 30°. As FIGS. 1 and 2 show, the ion outlet 11 is arranged on the edge of the back surface of the function head, said rear side surface is arranged opposite the brush field 6, so that the ions exiting from the ion outlet 11 form an ion cloud over the back of the function head 4. In particular, the ion outlet 11 can, as FIG. 1 shows, be arranged approximately, roughly speaking, in the area of transition between the handle 3 and the function head 4.

An energy supply unit is housed in the interior of the device basic body 2, which is not shown, which can preferably be designed in the form of a battery device or rechargeable device. Advantageously, the hair care device 1 is designed so as to be energy self-sufficient; i.e., it does not have a permanent mains part that would supply power from an electric outlet. Of course, a mains cable can be plugged in, in order to charge the accumulators inside device basic body 2. By means of the named energy supply unit, the ion discharge device 9 is supplied with energy in order to bring about the ion generation.

As FIG. 2 shows, the hair care device 1 is advantageously provided with a grounding device 20 in order to avoid unwanted device charging and impairment of the exiting of ions, and in order to improve the safety of the operation of the device. In the depicted embodiment according to FIG. 2, the grounding device 20 can have a grounding surface 21 in the area of the function head 4 that prevents the buildup of large charge fields in the area of the function head 4, in particular in the area of the hair treatment device 5. In the embodiment according to FIG. 2, the grounding surface 21 is connected directly to the hair treatment device 5, wherein the grounding surface is designed as a bearer and is seated under the hair treatment device 5, which is fashioned thereto; cf. FIG. 2. Here, the grounding surface 21 is advantageously made of a metallic surface and/or a metallic coating that is attached to the function head body, which is otherwise made of plastic. The grounding surface 21 can be connected to the device potential, in particular to ground components arranged inside the device.

Figure 3:
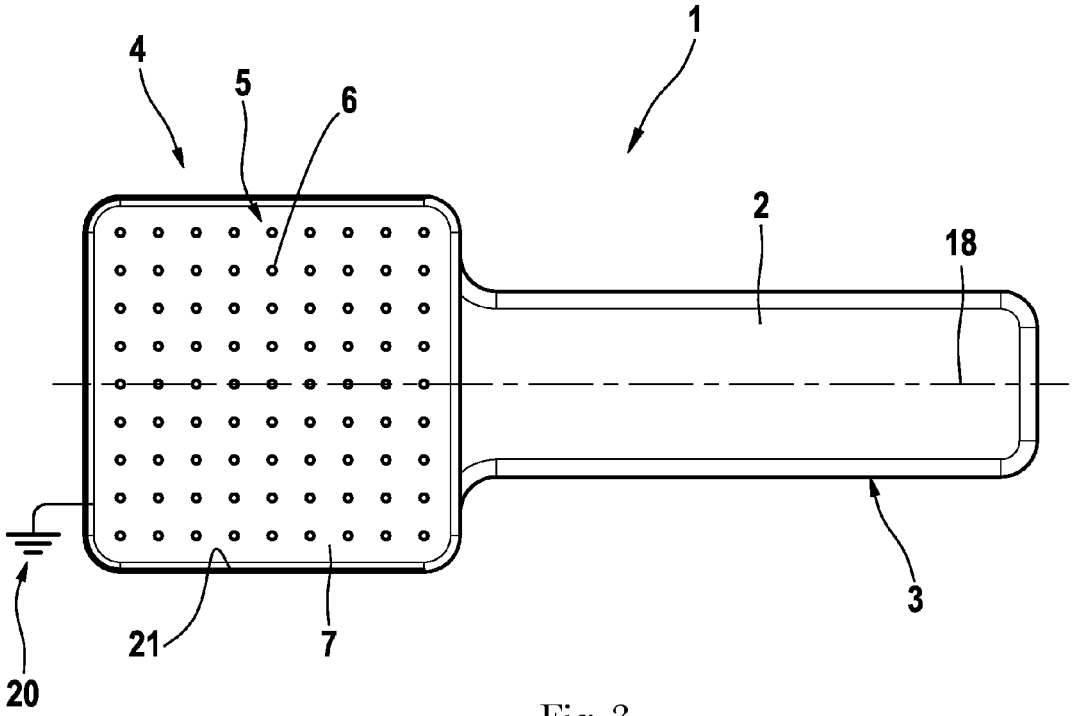
FIG. 3 shows a top view of the front of a hair brush according to a further advantageous embodiment of the present invention, in which the grounding surface on the function head is provided in the form of a metallic strip that surrounds the tooth field at the edge.

Alternatively, or in addition, the grounding surface 21 on the function head can also have a metallic surface body arranged on the edge of the brush field 6, preferably in the form of a metallic strip that surrounds the brush field 6 annularly, or, as is shown in FIG. 3, encloses it on three sides in a U-shape. The brush field 6 and the rest of the body of the function head 4 can be designed so as to be non-conductive, in particular made of plastic. In the case of a grounding surface 21 on the edge of the brush field 6 according to FIG. 3, the grounding surface 21 surrounds a part of the brush field 6 sufficient to compensate, to a sufficient degree, charges that arise there. Advantageously, the metallic strip will extend along at least 50% of the periphery of the hair treatment device 5.

Figure 4:
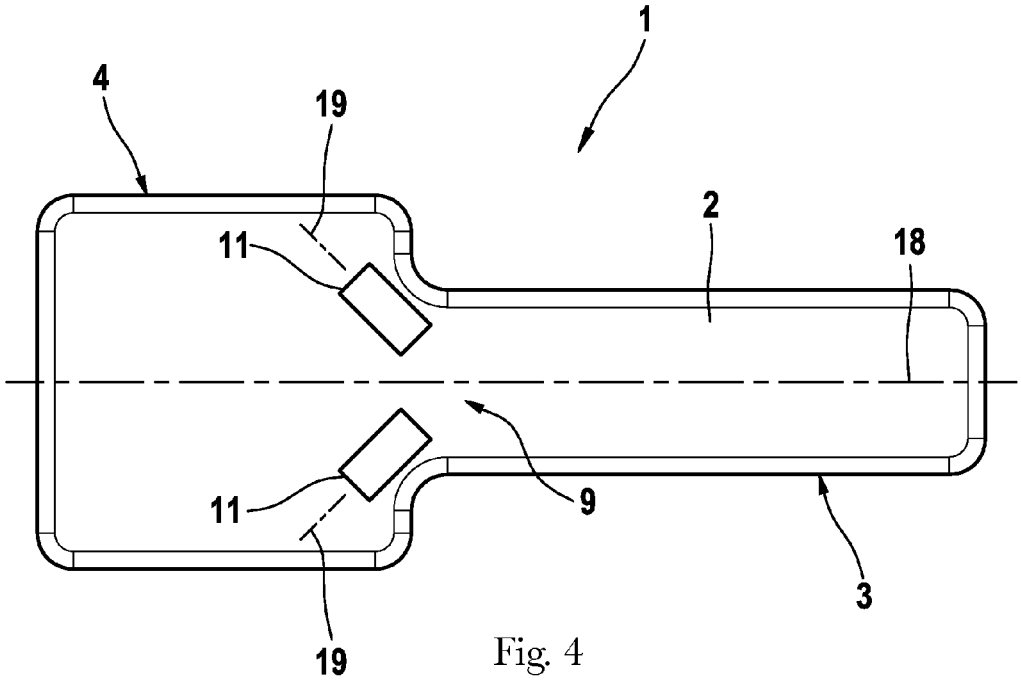
FIG. 4 shows a top view of the back of a hair brush according to a further advantageous embodiment of the present invention, which shows the arrangement of two ion outlets on the edge of the back of the function head symmetrical to the longitudinal center plane.
Figure 5:
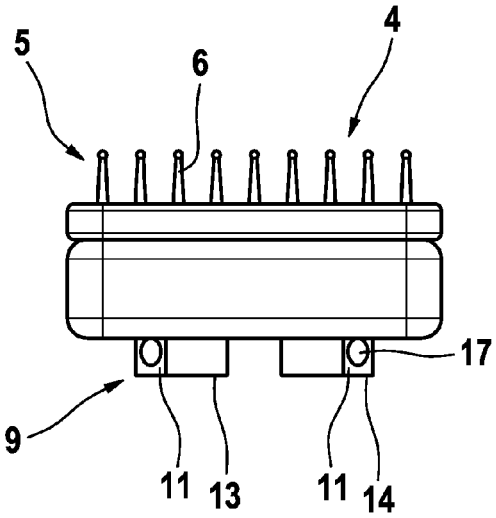
FIG. 5 shows a frontal view of the hair brush of FIG. 4, which shows the main exit directions of the ion outlets, said directions are spread relative to one another and run essentially parallel to the back surface of the hair brush.

As FIGS. 4 and 5 show, the hair care device 1 can also have a plurality of ion outlets 11 on its device rear side 8, wherein in the embodiment depicted according to FIGS. 4 and 5, two ion outlets 11 are provided that, regarded in the longitudinal direction of the device, are arranged at the same height and are positioned symmetrically to one another relative to the longitudinal center plane 18. Advantageously, the ion outlets 11 are arranged on the edge of the back of the function head, and are inclined relative to one another by an angle with the order of magnitude of 60° to 120°, preferably approximately 90°, in order to produce a uniformly distributed ion cloud. In the depicted embodiment, the ion outlets 11 are oriented with their main exit direction 18 parallel to the surface of the device rear side 8, so that the ions exit essentially parallel to the back of the function head. In the depicted embodiment, the ion outlets 11 cause the ions to exit in diverging directions in order to distribute an ion cloud uniformly over the function head 4, or the back thereof.

Figure 6:
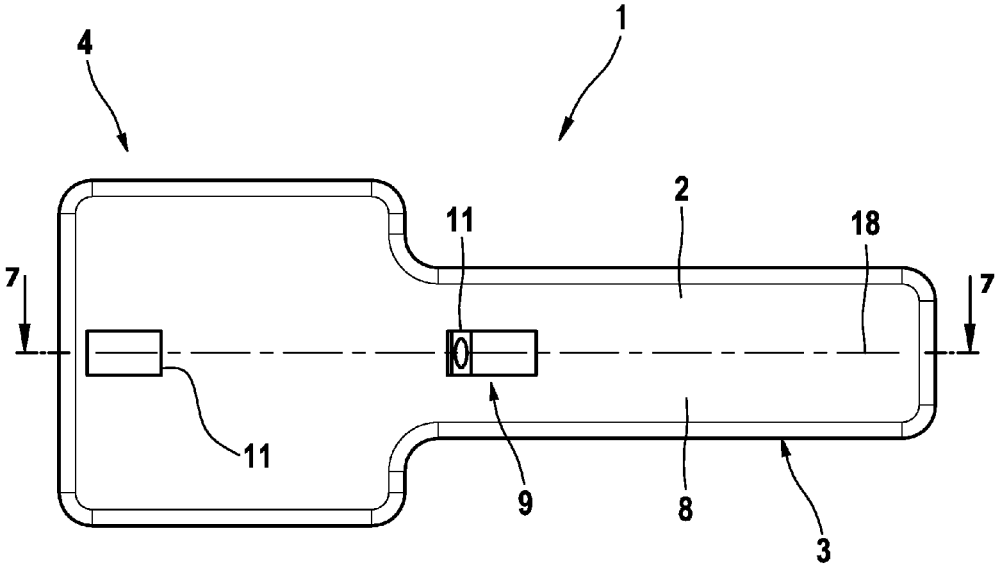
FIG. 6 shows a top view of the back of a hair brush according to a further advantageous embodiment of the present invention, in which two ion outlets are provided in the longitudinal center plane of the hair brush, directed opposite one another.
Figure 7:
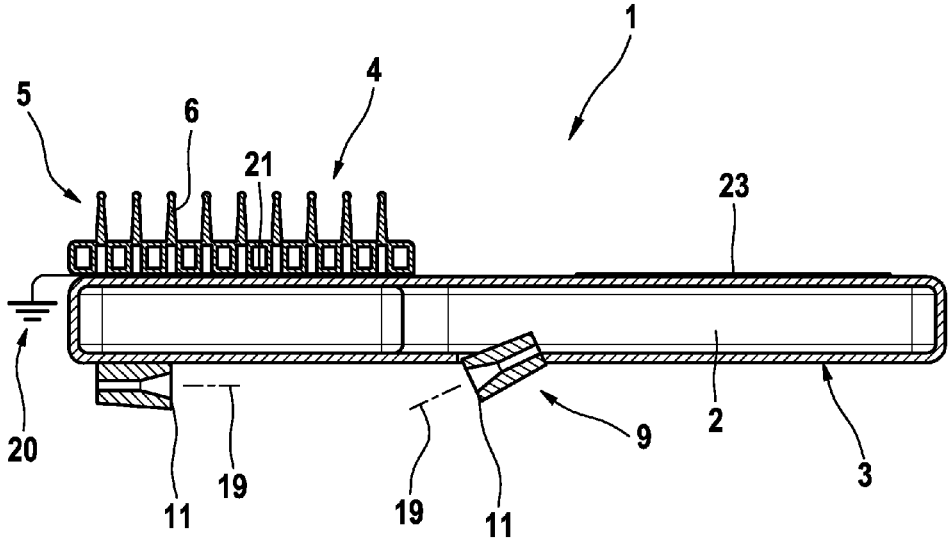
FIG. 7 shows a longitudinal section of the hair brush along the line A-A in FIG. 6, which shows the differing inclination of the ion outlets on the back of the hair brush.

Alternative to the embodiment according to FIGS. 4 and 5, a plurality of ion outlets 11 can also be arranged in the longitudinal center plane 18; cf. FIGS. 6 and 7. Advantageously, here the two ion outlets 11 are oriented opposite one another, wherein they are arranged on opposite sides in edge areas of the back of the function head (cf. FIGS. 6 and 7), in order to emit an ion cloud that arises over the back of the function head.

Advantageously, the two ion outlets 11 can be inclined differently to the surface of the back of the device. While the one ion outlet is oriented with its main exit direction 18 essentially parallel to the back surface of the device 8, the other ion outlet 11 is inclined at a slightly acute angle to the named surface of the back of the device, preferably at an angle of 0° to 40°, in particular 10° to 30°. As FIGS. 6 and 7 show, here it can be particularly advantageous if the ion outlet 11, arranged in the transition area between the handle 3 and the function head 4, is slightly inclined, while the ion outlet 11 arranged on the end of the back of the function head facing away from the handle 3 can be arranged parallel to the back of the device 8.

Figure 8:
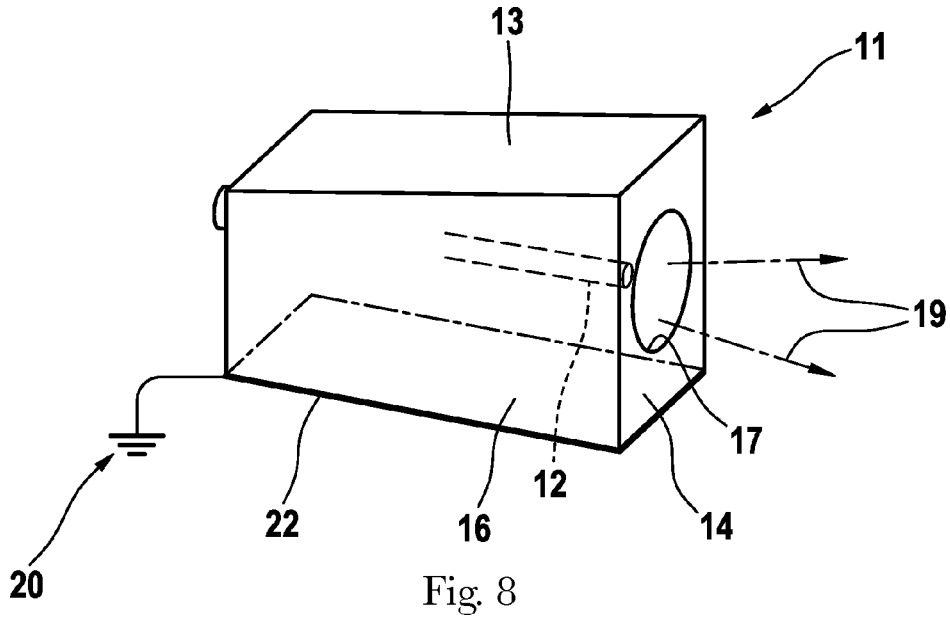
FIG. 8 shows a schematic perspective view of the ion outlet and its outlet housing according to an advantageous embodiment of the present invention in which a floor surface of the outlet housing is designed as a grounding surface.
Figure 9:
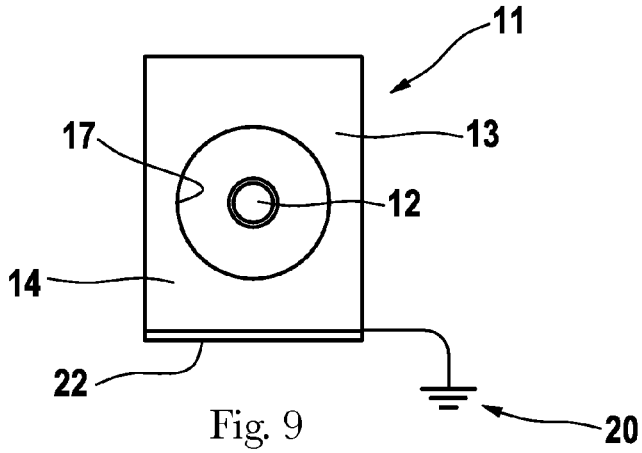
FIG. 9 shows a frontal top view of the port side of the ion outlet of FIG. 8.
Figure 10:
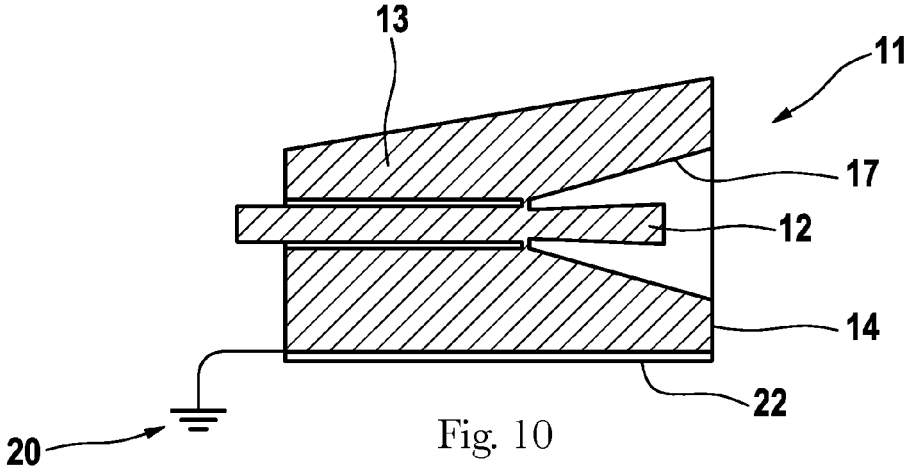
FIG. 10 shows a longitudinal section through the ion outlet from the two preceding Figures.

As FIGS. 8 through 10 show, the above-named grounding device 20 advantageously also comprises a grounding surface 22 allocated to the ion outlet 11. In particular, this grounding surface 22 is provided on a housing outer surface of the outlet housing 13 that surrounds the ion emitter 10 or the high-voltage element 12 thereof. As FIG. 8 best shows, the box-shaped outlet housing 13, roughly speaking, has a port side 14 that forms an end face, in which an exit opening 17 is provided for the exit of the discharged ions. The high-voltage element 12 is arranged centrally in the outlet housing 13 and terminates shortly before the named exit opening 17 in the interior of the outlet housing 13; cf. FIG. 10.

In the embodiment according to FIGS. 8 through 10, a side surface 16, which is peripheral relative to the high-voltage element 12, is provided with the grounding surface 22. According to FIGS. 8 through 10, this can be a floor of the outlet housing 13, facing the device basic body 2. Alternatively or in addition, this can also be a side wall surface 16 of the outlet housing 13, as is shown in FIG. 12.

Figure 11:
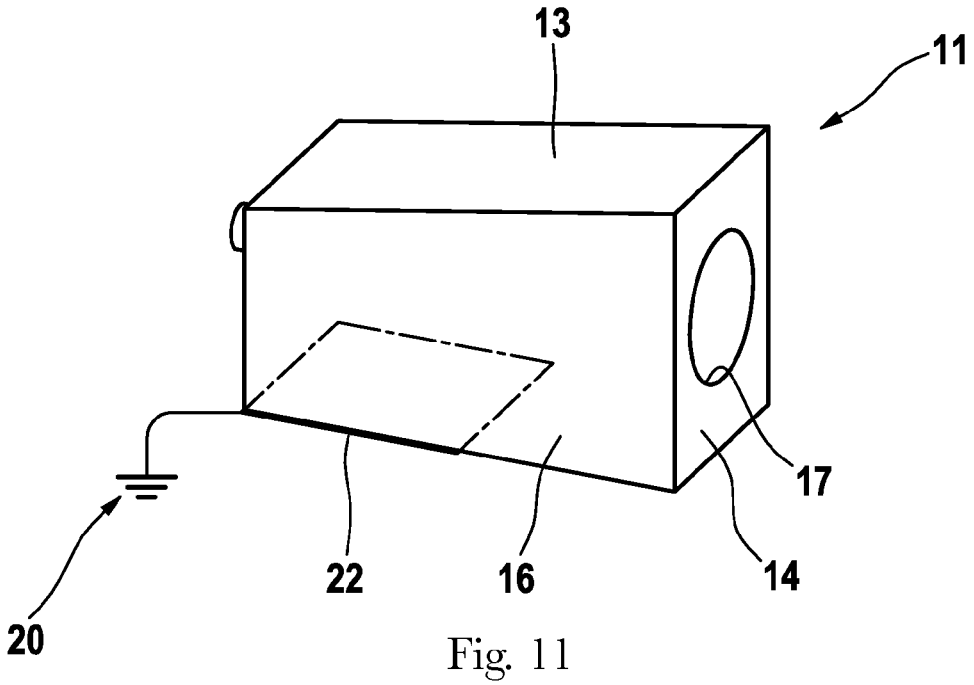
FIG. 11 shows a perspective schematic representation of an ion outlet according to an alternative advantageous embodiment of the present invention, in which only a partial area of the floor of the outlet housing is designed as a grounding surface.

According to FIGS. 8 through 10, the overall floor of the outlet housing 13 is designed as the grounding surface 22, in particular in the form of a metallic surface, wherein the remainder of the housing body can be designed so as to be nonconductive, in particular made of plastic. As FIG. 11 shows, the corresponding surface—in the case shown in FIG. 11, the floor surface—of the outlet housing 13 can also be provided with the grounding surface 22 only in some segments; i.e., the grounding surface 22 need not necessarily cover the entire side surface; cf. FIG. 11.

Figure 12:
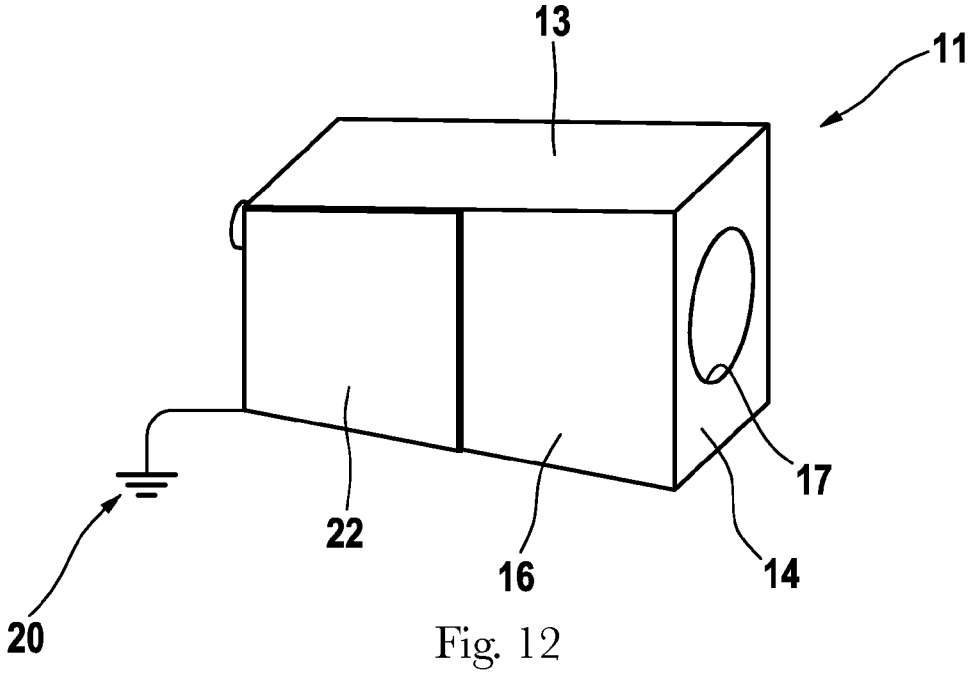
FIG. 12 shows a schematic perspective representation of an ion outlet according to a further advantageous embodiment of the present invention in which a side surface of the outlet housing is designed partly as a grounding surface.

In the embodiment according to FIG. 12 as well, only approximately half of the side surface 16 is designed as the grounding surface 22.

Figure 13:
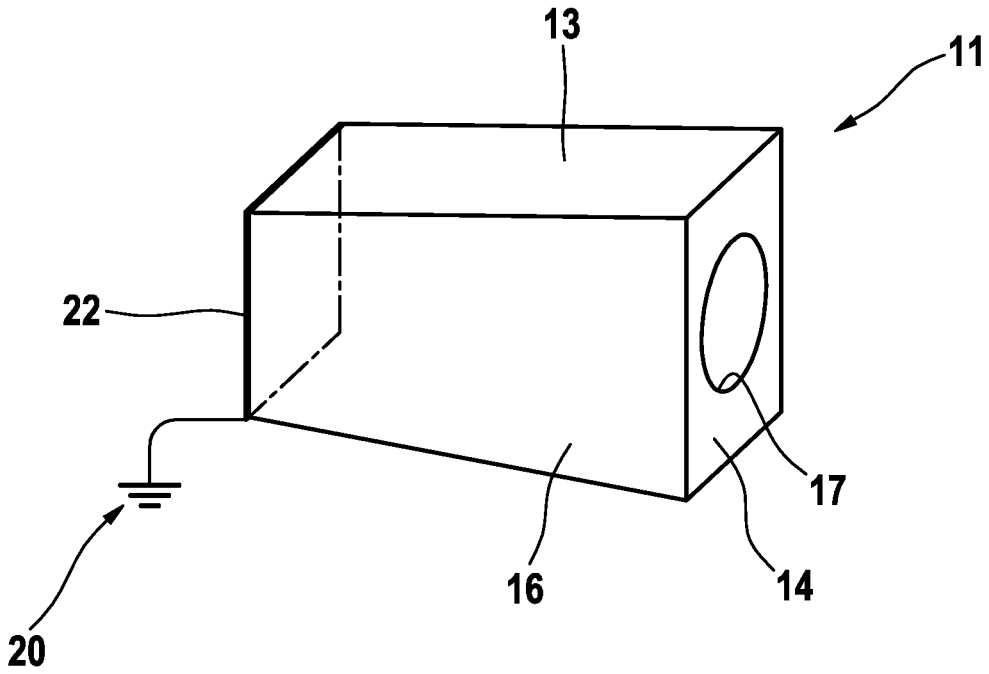
FIG. 13 shows a schematic perspective view of an ion outlet according to a further advantageous embodiment of the present invention, in which a back side, opposite the port side, of the outlet housing is designed as a grounding surface.

As FIG. 13 shows, the back of the outlet housing 13, situated opposite the port side 14, can also be designed as the grounding surface 22.

Figure 14:
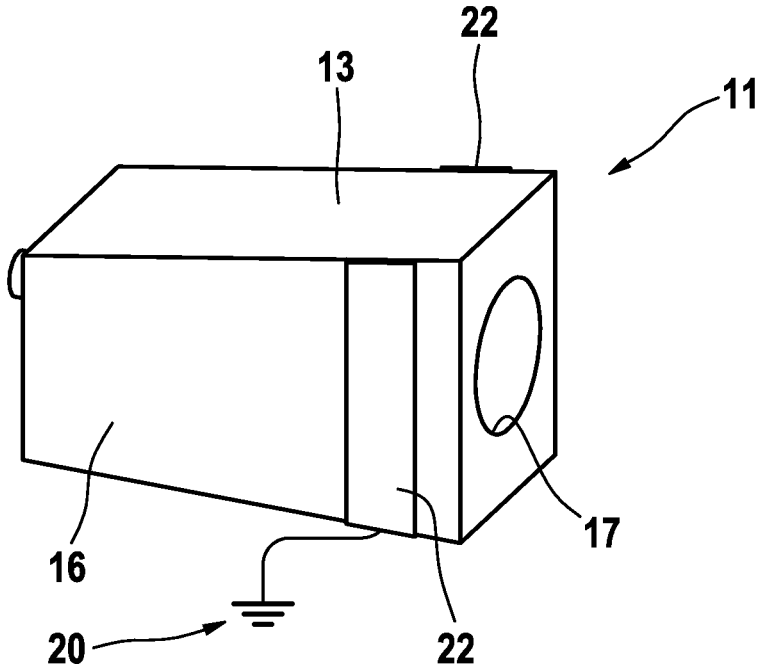
FIG. 14 shows a schematic perspective representation of an ion outlet according to a further advantageous embodiment of the present invention, in which two opposing side surfaces of the outlet housing are each partly designed as grounding surfaces.

Another embodiment is shown in FIG. 14. Here, the side surfaces 16, situated opposite one another, of the outlet housing 13 are each provided with a grounding surface 22, wherein in the depicted embodiment, these are designed only in the form of a strip that partly covers the side surface 16.

What is claimed is:

1. A hair care device comprising:

a handle and a function head connected to the handle said function head having a hair treatment device comprising a bristle field and/or comb tooth field thereon, said handle and said function head being made of a conductive material and each having a back surface opposite the hair treatment device, an ion-discharging device connected to a circuit, said ion-discharging device having at least one ion source enclosed in a housing and at least one ion outlet for discharging ions onto the hair, where said at least one ion outlet is located on at least one of the handle or the back surface of the function head, a metallic grounding surface attached to an external surface of the function head and/or handle for the for the conducting away/limitation of electrical charges, where the grounding surface is in electrical connection with the grounding potential of the circuit and the grounding surface does not extend into a portion of said handle gripped by a user.

2. The hair care device of claim 1 wherein the function head and/or the hair treatment device thereof and/or the housing part surrounding the ion outlet that is made, apart from the grounding surface, of nonconductive plastic.

3. The hair care device of claim 1 wherein the grounding surface is attached to the function head on the hair treatment device.

4. The hair care device of claim 1 wherein an additional grounding surface is located on the housing surface on the ion outlet that surrounds a high-voltage element for the discharging of the ions.

5. The hair care device of claim 1 wherein the housing part that surrounds the ion outlet comprises a port side in which an exit opening is provided for the exit of the ions, and has at least one further, closed housing side, and an additional grounding surface is provided on the closed housing side.

6. The hair care device of claim 5 wherein the port side of the ion outlet is designed so as not to have counter-electrodes.

7. The hair care device of claim 1 wherein the at least one ion outlet is arranged on the back surface of the device.

8. The hair care device of claim 7 wherein the at least one ion outlet is arranged with its main exit direction inclined to the back surface of the device at an angle of 0° to 45°.

9. The hair care device of claim 1 wherein at least one ion outlet, is situated on at least one of the back surface of the function head or the back surface of the handle.

10. The hair care device of claim 1 wherein an energy storage device is provided for the supply of energy to the ion discharge device.

11. The hair care device of claim 10 wherein the function head and/or the hair treatment device is designed so as to be detachable from a device basic body that forms the handle.

12. The hair care device of claim 3 wherein the grounding surface at least partially surrounds the function head.

13. The hair care device of claim 3 wherein the grounding surface completely surrounds the function head.

14. The hair care device of claim 1 wherein all of the ion outlets are situated on the back surface of the function head or the back surface of the handle.

15. The hair care device of claim 1 wherein the hair treatment device comprises a brush field, and the at least one ion outlet is located on a back surface of the device that faces away from the brush field when device is in use.

16. The hair care device of claim 1 wherein the ion discharging device comprises a high voltage element arranged in the at least one ion outlet, said ion outlet having an exit opening therein, said high voltage element having an end adjacent said exit opening, wherein in the case of at least one ion outlet, at least part of the grounding surface extends behind the end of the high voltage element that is adjacent the exit opening of the ion outlet, in an opposite direction relative to the main exit direction of the ion outlet.

* * * * *